US009683766B1

(12) United States Patent
Kreider et al.

(10) Patent No.: US 9,683,766 B1
(45) Date of Patent: Jun. 20, 2017

(54) SYSTEM AND METHOD FOR ELECTRONIC DE-CLOGGING OF MICROCOOLERS

(71) Applicant: LOCKHEED MARTIN CORPORATION, Bethesda, MD (US)

(72) Inventors: James Kreider, Goleta, CA (US); Krisna Bhargava, Santa Clara, CA (US); Elna Saito, Santa Barbara, CA (US)

( * ) Notice: Subject to any disclaimer, the term of this patent is extended or adjusted under 35 U.S.C. 154(b) by 216 days.

(21) Appl. No.: 14/330,316

(22) Filed: Jul. 14, 2014

Related U.S. Application Data

(60) Provisional application No. 61/845,581, filed on Jul. 12, 2013.

(51) Int. Cl.

| | |
|---|---|
| ***F25J 1/00*** | (2006.01) |
| ***F25B 47/00*** | (2006.01) |
| ***F22B 1/28*** | (2006.01) |
| ***F25B 9/02*** | (2006.01) |
| ***H01C 17/06*** | (2006.01) |

(52) U.S. Cl.
CPC ..... *F25B 47/00* (2013.01); *F22B 1/28* (2013.01); *F25B 9/02* (2013.01); *H01C 17/06* (2013.01); *F25B 2500/04* (2013.01)

(58) Field of Classification Search
CPC ..... F25B 9/02; F25B 47/00; F25B 47/003; F25B 47/006; F16L 53/004; F16L 53/005; F16L 53/007; H01C 17/06
USPC ..... 137/59; 138/32, 33
See application file for complete search history.

(56) References Cited

U.S. PATENT DOCUMENTS

| | | | |
|---|---|---|---|
| 1,925,934 | A | 9/1933 | Rimstad et al. |
| 2,383,486 | A | 8/1945 | Isenberg et al. |
| 3,884,814 | A | 5/1975 | Vogt et al. |

(Continued)

FOREIGN PATENT DOCUMENTS

| | | | |
|---|---|---|---|
| JP | 11-324914 | | 11/1999 |
| JP | 4422977 | B2 * | 3/2010 |

(Continued)

OTHER PUBLICATIONS

JP 4422977 B2 Translation.*

(Continued)

*Primary Examiner* — Frantz Jules
*Assistant Examiner* — Brian King
(74) *Attorney, Agent, or Firm* — Terry M. Sanks, Esq.; Beusse Wolter Sanks & Maire, PLLC

(57) ABSTRACT

A microcooler includes a substrate with a first and second microchannel and an orifice disposed between, in fluid communication with both. A pair of electrodes is in a vicinity of the orifice. An electrical resistive heating material is in electrical communication with the electrodes and is in thermal contact with a fluid in the vicinity of the orifice. A system includes the microcooler and a voltage source to apply a voltage across the electrodes, which induces sufficient heating in the heating material to disassociate something clogging the orifice, without significant damage to the heating material. Some systems include a sensor configured to detect an effect of clogging at the orifice. A processor is configured to receive sensor output from the sensor, and if there is an effect of clogging, then cause the voltage to be applied across the electrodes.

14 Claims, 10 Drawing Sheets

(56) References Cited

U.S. PATENT DOCUMENTS

| | | | | |
|---|---|---|---|---|
| 4,392,362 | A * | 7/1983 | Little | B21D 53/045 165/168 |
| 4,781,033 | A | 11/1988 | Steyert et al. | |
| 4,785,879 | A | 11/1988 | Longsworth et al. | |
| 4,908,112 | A | 3/1990 | Pace | |
| 4,911,846 | A | 3/1990 | Akasu et al. | |
| 5,249,425 | A | 10/1993 | Longsworth | |
| 5,382,797 | A | 1/1995 | Kunimoto et al. | |
| 5,758,822 | A * | 6/1998 | Yap | B05B 9/0403 239/1 |
| 5,920,133 | A | 7/1999 | Penswick et al. | |
| 6,041,821 | A * | 3/2000 | Grossman | E03B 7/14 134/22.1 |
| 6,189,433 | B1 | 2/2001 | Harada | |
| 6,621,071 | B2 * | 9/2003 | Sobel | F17C 13/006 250/214 R |
| 2003/0102435 | A1 | 6/2003 | Myers et al. | |
| 2004/0123605 | A1 | 7/2004 | Pruitt et al. | |
| 2005/0112001 | A1 | 5/2005 | Bahnen et al. | |
| 2005/0230085 | A1 | 10/2005 | Valenzuela | |
| 2006/0057407 | A1 | 3/2006 | Sambasivan et al. | |
| 2006/0231237 | A1 | 10/2006 | Dangelo | |
| 2009/0126373 | A1 | 5/2009 | Burg | |
| 2009/0258470 | A1 | 10/2009 | Choi et al. | |
| 2009/0272270 | A1 | 11/2009 | McGill et al. | |
| 2011/0174467 | A1 | 7/2011 | Herbst | |
| 2012/0229959 | A1 | 9/2012 | Holcomb | |
| 2013/0161705 | A1 | 6/2013 | Disney et al. | |

FOREIGN PATENT DOCUMENTS

| | | |
|---|---|---|
| KR | 10-1999-0057578 | 7/1999 |
| WO | 0053992 | 9/2000 |
| WO | 2013016224 | 1/2013 |

OTHER PUBLICATIONS

Mello et al., "Precise Temperature Control in Microfluidic Devices Using Joule Heating of Ionic Liquids," Miniaturisation for Chemistry, Biology & Bioengineering, Lab Chip, 2004, pp. 417-419.

Wu et al., "Polydimethylsiloxane Microfluidic Chip with Integrated Microheater and Thermal Sensor," Biomicrofluidics, Mar. 2009, 3(1): 012005.

Esser-Kahn, et al., Three-Dimensional Microvascular Fiber-Reinforced Composites, Advanced Materials, wileyonlinelibrary.com, WILEY-VCH Verlag GmbH & Co. KGaA, Weinheim, 2011, XX, pp. 1-5.

* cited by examiner

SYSTEM AND METHOD FOR ELECTRONIC DE-CLOGGING OF MICROCOOLERS

CROSS-REFERENCE TO RELATED APPLICATIONS

This application claims the benefit of U.S. Provisional Application No. 61/845,581 filed Jul. 12, 2013, under 35 U.S.C. §119(e).

BACKGROUND

Cryogenic cooling systems are employed in various demanding applications including military and civilian active and remote sensing, superconducting, and general electronics cooling. Such applications often demand efficient, reliable, and cost effective cooling systems that can achieve extremely cold temperatures, e.g., below 140 Kelvin and minimize the consumption of valuable and scarce size and weight capacities.

In an effort to address the forgoing applications, Joule-Thomson (J-T) microcoolers have been employed. As used herein and throughout this specification, the term "microcooler" shall be understood to include: cryocoolers, cryostats, and the like with microscale features (features with sizes on the order of 1 to 1000 microns, where 1 micron is one micrometer, μm, 1 μm=$10^{-6}$ meters). Briefly, J-T cooling occurs when a non-ideal gas compressed at high pressure encounters low pressure and expands adiabatically (i.e., at constant enthalpy). This is typically achieved on the microscale by connecting a high pressure microchannel through a smaller width orifice (often part of a tapered nozzle) to a relatively wide microchannel, such as a microscale expansion chamber.

Undesirably, conventional J-T microcoolers oftentimes suffer from failure caused by clogging within small orifices, nozzles and/or channels through which the cooling fluid passes. The clogging may occur as a result of impurities or particulates forming at the inlet/outlet ports of the microcooler. These impurities and/or particulates can originate as condensable organic gasses, water, dust, compressor oils, manufacturing residues and/or combinations thereof formed by the refrigeration process.

In macro-scale J-T cryocoolers, the clogging problem is generally solved mechanically by destabilizing the orifice mechanism in response to gas flow or temperature conditions in the input line or gas reservoir. For example, a system may have a plunger duct which expands to allow particulate matter through when changes in the incoming gas flow rate is sensed. Unfortunately, implementation of mechanically reactive orifices is not practical or economical in J-T microcoolers due to materials, processing and the dominance of adhesive forces over inertial forces associated with such small physical scales.

SUMMARY

Embodiments relate to an apparatus, system and a method for electronic de-clogging of a microcooler, such as a Joule-Thomson microcooler.

In a first set of embodiments, an apparatus includes a substrate with a first microchannel, a second microchannel and an orifice. The orifice is disposed between the first microchannel and the second microchannel, and is in fluid communication with both. The orifice is configured to separate a region of non-divergent fluid flow from a region of divergent fluid flow. A pair of electrodes is disposed in a vicinity of the orifice. An electrical resistive heating material is disposed in electrical communication with the pair of electrodes and is configured to be in thermal contact with a fluid in the vicinity of the orifice.

In some embodiments of the first set, the second microchannel is an expansion chamber, and the orifice is configured to induce a fluid under pressure in the microchannel to expand into low pressure in the expansion chamber. In some of these embodiments, the orifice and substrate are configured so that expansion is adiabatic, and the microcooler is thus a Joule-Thomson microcooler.

In some embodiments of the first set, the resistive heating material is configured in a serpentine pattern on the substrate. In some embodiments of the first set, the resistive heating material is a thin film layer deposited on the substrate. In some embodiments of the first set, the apparatus includes a passivation layer disposed on the resistive heating material. The passivation layer is configured to separate the resistive heating material from fluid in the first microchannel and the orifice and the second microchannel.

In a second set of embodiments, a system includes the apparatus as recited above and a voltage source configured to apply a voltage across the pair of electrodes. The voltage is sufficient to induce sufficient heating in the electrical resistive heating material to melt a particle or condensate clogging the orifice without significant damage to the electrical resistive heating material.

In some embodiments of the second set, the system includes at least one sensor and a processor. The at least one sensor is configured to detect an effect of clogging at the orifice. The processor is configured to perform at least the steps of receiving sensor output from the at least one sensor, determining an effect of clogging based on the sensor output, and if it is determined that there is an effect of clogging, then causing the voltage source to apply the voltage across the pair of electrodes.

In a third set of embodiments, a method includes etching into a first substrate an orifice disposed between and in fluid communication with a first microchannel and a second microchannel. The method includes depositing electrical resistive heating material onto an outer surface of the substrate in a vicinity of the orifice. The method also includes depositing electrically conducting material for the plurality of electrodes in contact with the electrical resistive heating material. The method yet further includes applying surface passivation methods to a surface of the electrical resistive heating material.

In a fourth set of embodiments, a method includes operating the microcooler to cool a thermal load in thermal contact with the second microchannel. The method also includes obtaining sensor output from at least one sensor configured to detect an effect of clogging at the orifice. The method further includes determining an effect of clogging based on the sensor output, and if it is determined that there is an effect of clogging, then causing a voltage source to apply a voltage across the pair of electrodes for a limited time. The voltage applied for the limited time is sufficient to induce sufficient heating in the electrical resistive material to melt a particle or condensate clogging the orifice without significant damage to the electrical resistive heating material.

BRIEF DESCRIPTION OF THE DRAWINGS

A more particular description briefly stated above will be rendered by reference to specific embodiments thereof that are illustrated in the appended drawings. Understanding that these drawings depict only example embodiments and are not therefore to be considered to be limiting of its scope, the embodiments will be described and explained with additional specificity and detail through the use of the accompanying drawings in which.

DETAILED DESCRIPTION

Figure 1A:
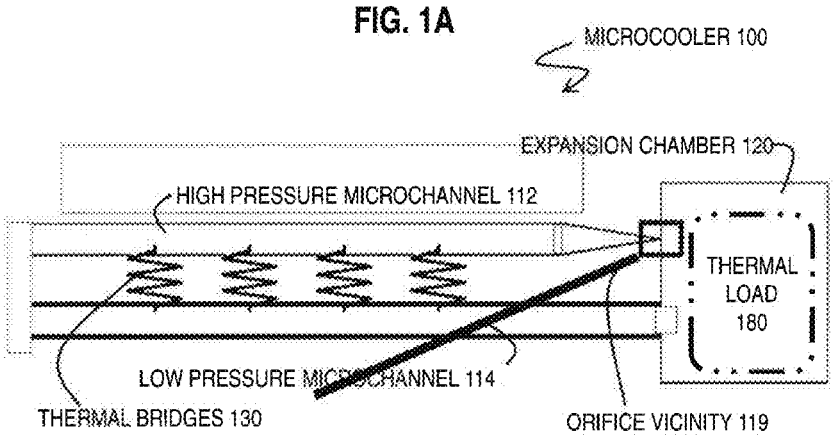
FIG. 1A is a diagram that illustrates an example microcooler that benefits according to one or more embodiments.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Throughout this specification and the claims, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the item, element or step modified by the article.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Although specific embodiments are described below in the context of Joule-Thomson microcoolers for use with focal plane array infrared imagers, other embodiments are not limited to this context but may include other microcoolers with clogging caused by condensates, such as liquid nitrogen microcoolers, in which contaminates may condense at orifices where fluid flow changes in a system of microchannels and micro chambers. In general, a condensate is a liquid produced by condensation, the change of the physical state of matter from a gas phase into a liquid phase. However, as used herein, for convenience, the term "condensate" will also refer to any solid formed from the liquid, e.g., due to temperatures below the melting point of the material of the original gas. A particle is a solid that has not necessarily formed from a condensate. A "fluid" refers to any phase of matter which is deformed under a shear stress, including liquids and gases.

Overview

FIG. 1A is a diagram that illustrates an example microcooler 100 that benefits according to one or more embodiments. The microcooler includes high pressure microchannel 112 that leads through a tapering nozzle to an orifice into an expansion chamber 120. The vicinity 119 of the orifice is indicated by a dotted box. At the orifice, fluid flow changes from laminar flow to divergent expansion. A low pressure microchannel 114 serves to exhaust the fluid from the expansion chamber 120. In the illustrated embodiment, microcooler efficiency is improved by including multiple thermal bridges 130 (also called thermal straps) that conduct heat between the high pressure microchannel and the low pressure microchannel. During operation, a fluid, such as a compressed gas cools as it spreads into the expansion chamber 120 from microchannel 112 at the orifice. The expanded lower temperature gas is used to cool a thermal load 180 in thermal contact with the expansion chamber 120, such as being disposed above or below the expansion chamber, as indicated by a dot-dashed line. The low pressure gas is evacuated through the low pressure microchannel 114.

Even after taking some of the heat from the thermal load 180, the low pressure gas is often cooler than the fluid in the high pressure microchannel 112. The thermal bridges 130 tend to conduct heat from the fluid in high pressure microchannel 112 to the exhaust fluid in microchannel 114, which makes the high pressure gas capable of greater cooling during expansion.

J-T cooling occurs when a non-ideal gas expands from high to low pressure at constant enthalpy. The pressure change occurs as a result of the gas passing through small orifices or nozzles. In a Joule-Thomson microcooler, the high pressure microchannel 112 carries a non-ideal gas, often made up of a mixture of gases; and the thermal load is thermally insulated from the orifice to allow adiabatic expansion at the orifice.

In some other microcoolers, gas is allowed to expand non-adiabatically and the thermal load 180 is in thermal contact in the vicinity 119 of the orifice, or the expansion is more gradual, or a more ideal gas is used, or some combination. In yet other microcoolers, e.g., a liquid nitrogen cooler, the expansion chamber is eliminated and there are simple microchannels of different widths before and after an orifice.

Figure 1B:
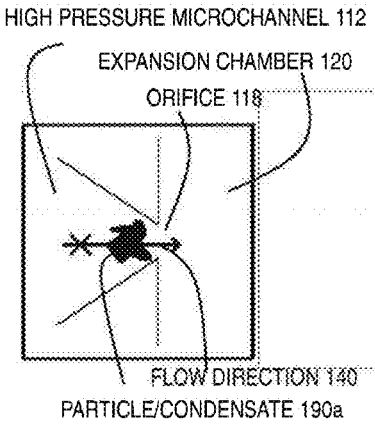
FIG. 1B and FIG. 1C are diagrams that illustrate examples of clogging of an orifice in the microcooler of FIG. 1A.
Figure 1C:
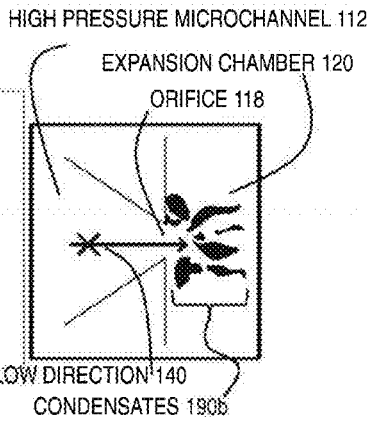

FIG. 1B and FIG. 1C are diagrams that illustrate examples of clogging of an orifice in the microcooler of FIG. 1A. FIG. 1B shows a condensate or other particle 190*a* blocking the orifice 118 from the high pressure microchannel 112 side; thus, retarding or stopping the flow of a fluid into the expansion chamber 120, as indicated by the X on the flow direction arrow. FIG. 1C shows the orifice 118 blocked by condensates 190*b* on the side of the expansion chamber 120 generated by the very low temperatures at that spot, thus, retarding or stopping the flow of a fluid into the expansion chamber 120, as indicated by the X on the flow direction arrow. These condensates 190*a*, 190*b* can originate as condensable organic gasses, water, dust, compressor oils, manufacturing residues, contaminants or combinations thereof formed during the microcooling process.

As discussed generally above, two types of contamination are common problems with J-T microcoolers and similar microcoolers: particles and condensable gases. In the case of particles, fine-mesh, metal filters have been used to eliminate particles from the gas stream. Such mechanical solutions may be installed in the high pressure outlet of the orifice to remove these substances. It is, however, very difficult to achieve high purity gases for J-T compatible operations. This is especially difficult when starting gases include <1 part per million (ppm) of total condensable contaminants. Thus, as the J-T microcooler operates with dilute condensable contaminants, the condensable gases freeze and build-up near the orifice and eventually clog the small diameter orifice. The main substances that will clog a J-T microcooler are dilute, condensable vapors in the gas stream that have a freezing point above the operating temperature of the J-T microcooler. In operating temperatures in the range of <150 K required for infrared (IR) focal plane array performance, the trace substances that can be frozen include water, oils (from compressors), carbon dioxide, carbon monoxide, and other organic compounds.

Figure 2A:
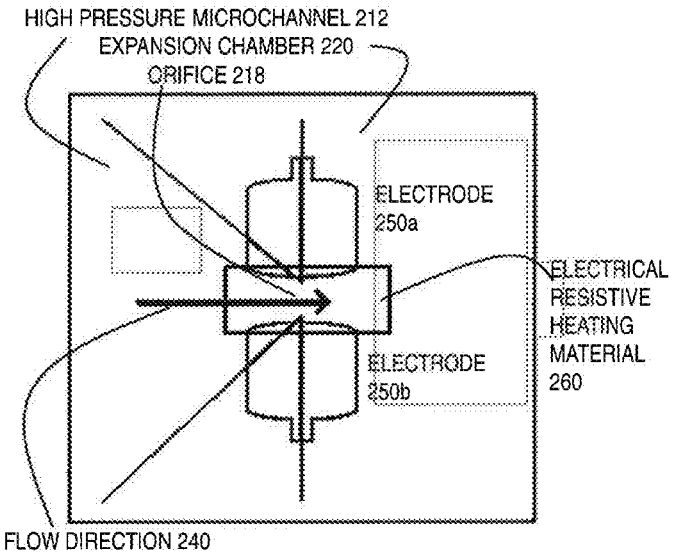
FIG. 2A is a diagram that illustrates an example pair of electrodes and electrical resistive heating material in a vicinity of an orifice of a microcooler, according to one embodiment.

FIG. 2A is a diagram that illustrates an example pair of electrodes 250*a* and 250*b* and electrical resistive heating material 260 in a vicinity of an orifice 218 of a microcooler, according to one embodiment. The diagram depicts the vicinity of orifice 218 between the first, high pressure microchannel 212 and a second microchannel, such as the expansion chamber 220. Flow direction is from the first to the second microchannel through the orifice 218. In the vicinity of the orifice 218, a pair of electrodes 250*a* and 250*b* are positioned, bracketing the orifice, accessible to a surface of the device, in a plane either above or below the orifice or both. In some embodiments, both electrodes are on one side of the orifice, ether left or right of the direction of fluid flow or upstream or downstream of the orifice; and, the electrodes do not bracket the orifice.

In the illustrated embodiment, an electrical resistive heating material 260 is disposed between the electrodes and in electrical contact with both electrodes and in thermal contact with the vicinity of the orifice 218. The electrical resistive heating material is selected to produce sufficient heat, when a voltage is applied between terminal electrodes 250*a* and 250*b*, to melt or burn or otherwise disassociate particles or condensates that may clog the orifice. In some embodiments, the electrical resistive heating material 260 is the same as the substrate. In various embodiments the electrical resistive heating material is selected from a group comprising high resistance materials, such as chromium (Cr), nickel (Ni), Nichrome (20% Cr/80% Ni), titanium I chromium (Ti/Cr) layers, tantalum nitride (Ta2N), Kanthal (73% Fe I 21% Cr I 6% Al), among others.

Figure 2B:
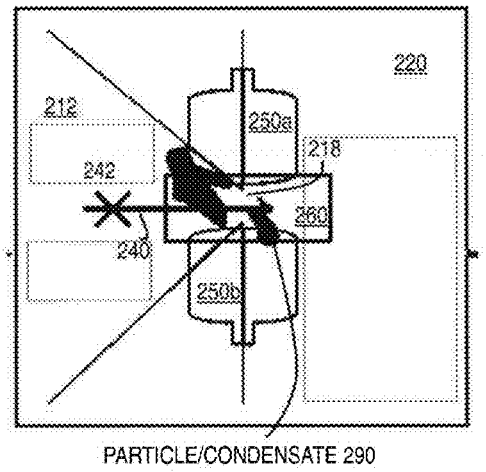
FIG. 2B is a diagram that illustrates example clogging of the orifice of FIG. 2A, according to an embodiment.
Figure 2C:
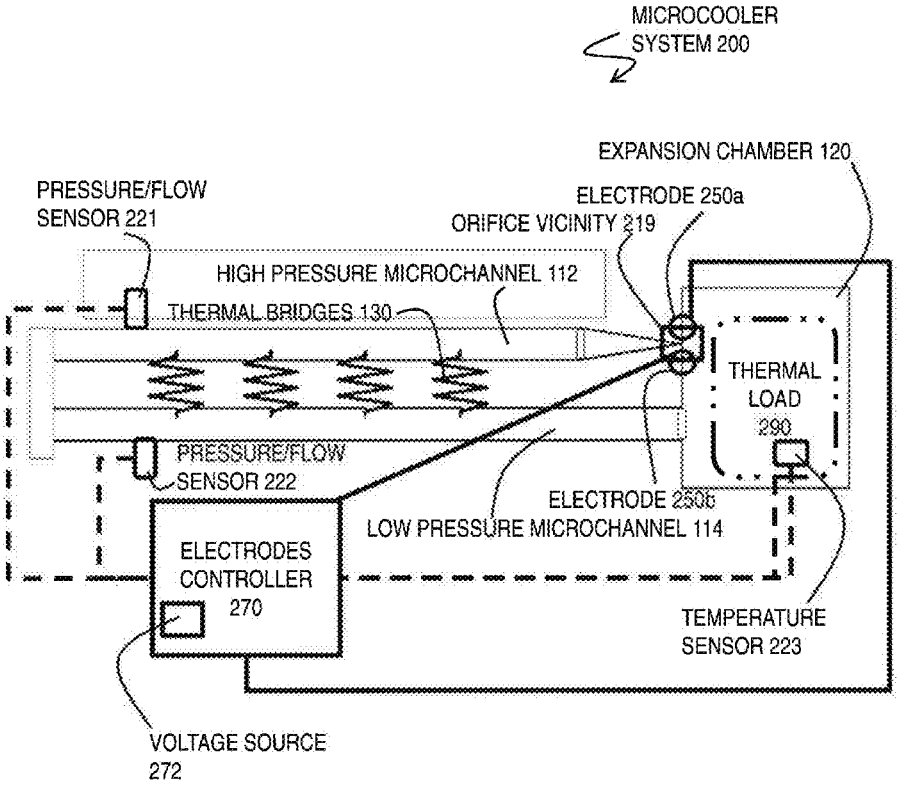
FIG. 2C is a diagram that illustrates an example system using the apparatus of FIG. 2A, according to an embodiment.
Figure 2D:
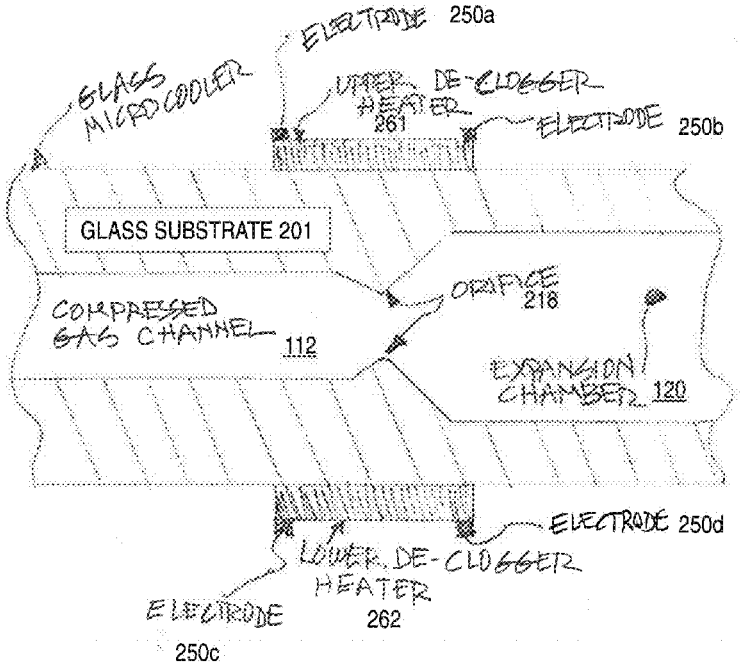
FIG. 2D is a block diagram that illustrates an example cross section of a J-T microcooler with de-clogging heaters in a vicinity of an orifice, according to an embodiment.

FIG. 2D is a block diagram that illustrates an example cross section of a microcooler with de-clogging heaters in a vicinity of an orifice, according to an embodiment. This cross section is perpendicular to the plan view of FIG. 2A along an axis of microchannel 112. The microchannel 112 is in fluid communication with the expansion chamber 120 through orifice 218, all formed within glass substrate 201. In some embodiments, glass substrate 201 comprises an upper glass plate and lower glass plate into which upper and lower portions of microchannel 112, orifice 218 and expansion chamber 120 are each partially formed; and, the glass plates are subsequently bonded together to form substrate 201. Along each of an upper and lower outer surface of substrate 201, in a vicinity of the orifice 218, is disposed a microheater material layer 261 and microheater material layer 262, respectively, each in electrical contact with a pair of electrodes. In the illustrated embodiment, microheater material layer 261 is in electrical contact with a pair of electrodes 250*a* and 250*b*, while microheater material layer 262 is in electrical contact with a pair of electrodes 250*c* and 250*d*. In other embodiments one of the microheater material layers and corresponding electrodes is omitted. In the illustrated embodiments, both microheater material layers are centered on the orifice 218. In other embodiments, one or more of the microheater layers are not centered on the orifice.

In some embodiments, in which the thermal load is an electromagnetic detector, the voltage applied across the terminals 250*a* and 250*b* and rate of change of the voltage to induce heating is selected so as not to interfere with the operation of the detector.

In some embodiments in which the total size and weight of the microcooler is restricted, it is advantageous for the electrical resistive heating material layer to be deposited as a thin film, e.g., using an evaporated thin film process to deposit an evaporated thin film. In such embodiments, it is also advantageous for the electrical resistive heating material to undergo negligible sacrifice of the material itself; and thus, it is advantageous that the thin film have high electric resistance and therefore low electric current when a voltage is applied. Negligible sacrifice means that sufficient thin film remains to cause heating after millions of applications of an operative voltage for durations of milliseconds to minutes. High electric resistance is accomplished in some embodiment by increasing the length and decreasing the width of the resistive heating material connecting the electrodes. Because the heating is confined to a small area in the vicinity of the orifice, the extended length and narrow width is achieved in some embodiments by using a serpentine pattern between the electrodes, as described in more detail below with reference to FIG. 3.

FIG. 2B is a diagram that illustrates example clogging of the orifice of FIG. 2A, according to an embodiment. Particles or condensates or some combination 290 retard or entirely block flow in direction 240 as signified by the cross 242. To de-clog, voltage is applied across electrodes 250*a* and 250*b*, causing the electrical resistive heating material 260 to heat up and raise the temperature in the vicinity of the orifice 218, for a limited time until the particles and condensates melt or burn or otherwise disassociate sufficiently to flow past and away from the orifice 218.

Thus, as described and illustrated above, an apparatus includes a substrate having disposed therein a first microchannel 212, a second microchannel (e.g., expansion chamber 220) and an orifice 218 disposed between the first microchannel and the second microchannel and in fluid communication with both. The orifice is configured to change fluid flow (e.g., from non-divergent, laminar to divergent). The apparatus also includes a pair of electrodes disposed in a vicinity of the orifice. The apparatus includes an electrical resistive heating material in electrical communication with the pair of electrodes and configured to be in thermal contact with a fluid in a vicinity of the orifice.

FIG. 2C is a diagram that illustrates an example system using the apparatus of FIG. 2A, according to an embodiment. The system 200 is a microcooler as depicted in FIG. 1A with the addition of electrodes 250*a* and 250*b* in new orifice vicinity 219, an electrodes controller 270, and sensors 221, 222 and 223. Electrodes controller 270 includes a voltage source 272 and logic circuits for controlling it, such as a processor chip set described in more detail below with reference to FIG. 9. The electrodes controller 270 switchably connects the voltage source 272 to the electrodes 250*a* and 250*b* in order to apply a switchable voltage difference between those electrodes. In some embodiments the vicinity 219 of orifice 218 includes the electrical resistive heating material 260.

Thus, the microcooler system 200 includes the apparatus of FIG. 2A and a voltage source configured to apply a voltage across the pair of electrodes. The voltage is sufficient to induce sufficient heating in the electrical resistive heating material to burn, melt or otherwise disassociate a particle or condensate clogging the orifice without significant damage to the electrical resistive heating material. However, the heating is controlled to prevent the vicinity of the orifice from becoming too hot. If the temperature rises too high, the thermal load is adversely affected. Thus in some embodiments, such as embodiments in which the thermal load is an infrared focal plane array, the heating is limited so that temperature does not rise above about 300 K for more than a limited time, which is sufficient to remove most particles and condensates from contaminants and melt ice. For this reason, the voltage is switched on for a limited time, e.g., just enough to remove the blockage and not enough to raise the temperature of the thermal load, for example, in a range from a few milliseconds to a few seconds.

In some embodiments, the electrodes controller 270 switches the voltage on and off based on output from one or more sensors that are capable of detecting the effects of clogging. Connections carrying sensor output to the electrodes controller (and any commands from the controller to the sensors) are indicated by dashed lines in FIG. 2C.

For example, if there is clogging, then the flow rate in the first microchannel 112 or second microchannel 114 downstream of the expansion chamber 120 decreases. This effect of clogging can be detected by a flow sensor 221 or flow sensor 222 located in the first microchannel or second microchannel, respectively, or some combination. In some embodiments, clogging causes pressure increase in the first microchannel and pressure decrease in the second microchannel. This effect of clogging can be detected by a pressure sensor 221 or pressure sensor 222 located in the first microchannel or second microchannel, respectively, or some combination.

Another effect of clogging is an increase in temperature of the thermal load 290. This effect of clogging is detected, in some embodiments, by a temperature sensor 223 in thermal contact with the thermal load 290.

In some embodiments, the thermal load 290 is a sensor of some kind, such as an infrared focal plane array, that is temperature sensitive. As a consequence, some statistic of the data from the sensor of thermal load 290, e.g., a background noise level increases, or the signal to noise ratio decreases as the temperature rises. This effect of clogging is detected, in some embodiments, by output from the sensor included in the thermal load 290.

Based on the output from one or more of these sensors, the logic circuits in the electrodes controller 270 determines whether there is evidence of clogging. If so, the voltage source is switched on to apply a voltage difference across the electrodes 250*a* and 250*b* for a limited time to induce sufficient heating to melt, burn or otherwise disassociate the particles or condensates in the vicinity 219 of the orifice 218. Thus, in some embodiments, a microcooler system 200 includes a processor 270 and at least one sensor (e.g., sensors 221, 222, 223 or 290) configured to detect an effect of clogging at the orifice 218. The processor is configured to perform at least the steps of receiving sensor output from the at least one sensor, determining an effect of clogging based on the sensor output, and, if it is determined that there is an effect of clogging, then causing the voltage source to apply the voltage across the pair of electrodes.

An evaporated thin-film process is a method that can be used to deposit the electrical resistive heating material to melt, burn or otherwise disassociate contaminants that have frozen out of the gas stream and have clogged the orifice of the microcooler. This type of heater can be fabricated onto the dielectric layers or substrates of the microcooler using similar photolithographic techniques that are employed during the fabrication of the microcooler itself.

Example Embodiments

Figure 3:
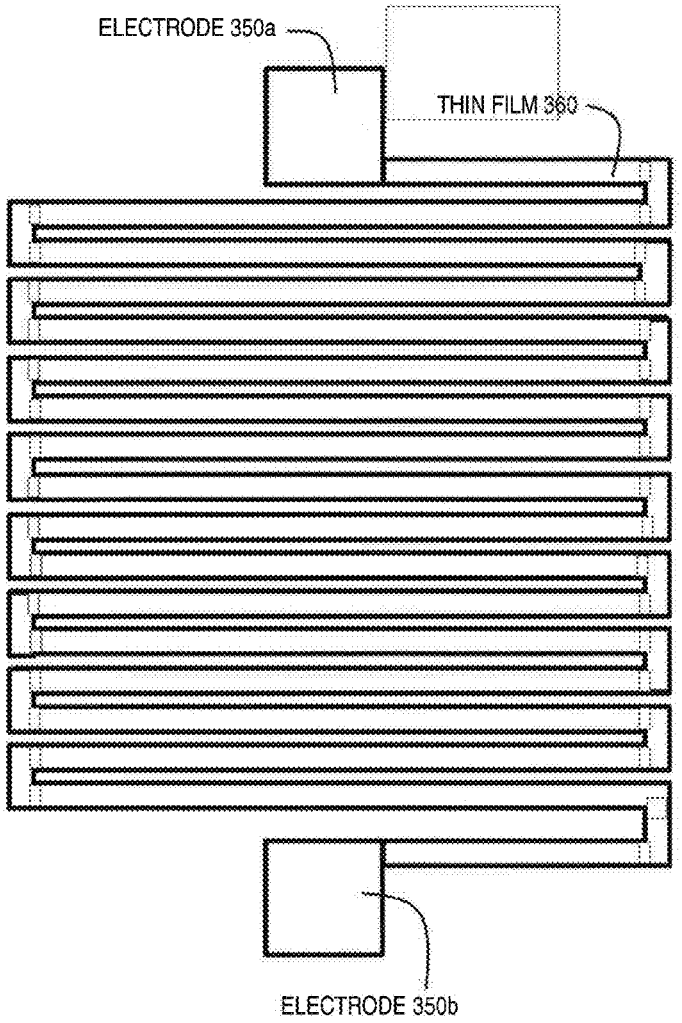
FIG. 3 is a diagram that illustrates an example serpentine pattern for a thin layer of electrical resistive heating material, according to an embodiment.

FIG. 3 is a diagram that illustrates an example serpentine pattern for a thin film layer 360 of electrical resistive heating material, according to an embodiment. The serpentine pattern is used to increase the resistance of the circuit. There is an electrical contact pad (such as gold) at each end of the serpentine pattern to serve as electrodes 350*a* and 350*b* for connection to the electrical circuit that includes the electrodes controller 270. This connection can typically be made by wire bonding or a soldering operation.

This type of heater is well suited for a microcooler since it is thin (doesn't add much volume to the microcooler), small in foot print (can be designed so that it is compatible with the overall size of the microcooler), and requires lower current in order to apply a given amount of watts to the heating location (higher resistance requires higher voltage and thus lower current by design of the width, thickness, and length of the serpentine pattern). Current with too high an amperage can damage the thin-film layer.

The electrical formula governing the current through the resistive material, such as thin film 360, is Ohms Law, given by Equation 1:

$$V=R\times I \quad (1)$$

where V is applied voltage in volts, R is electrical resistance in ohms (enhanced by the serpentine pattern), and I is current in amperes. The heat produced is proportional to the amount of power P consumed by the resistive material, as given by Equation 2:

$$P=V\times I \quad (2)$$

where P is in watts.

For purposes of illustration, it is assumed that a Nichrome thin film embodiment includes a thickness for the Nichrome film of about 1000 angstrom (Å, 1 Å=$10^{-10}$ meters) with a thin film line width of 80 micrometers (μm, 1 μm=$10^{-6}$ meters) and 10 μm spacing between thin film lines. For a serpentine line length/width ratio of about 1,040, the resistivity is 250 micro-ohm·centimeters (1 micro-ohm, μOhm=$10^{-6}$ Ohms, and 1 centimeter, cm, =$10^{-2}$ meters), which yields a resistance of 40 kilo-ohms (kOhms, 1 kOhm=$10^{3}$ Ohms). For an applied voltage of 100 volts, the current through the resistor is 2.5 milliamps (mA, where 1 mA=$10^{-3}$ amperes), and the resultant heating power is 0.25 watts. The overall size of this thin film pattern is about 2.8 millimeters (mm, 1 mm=$10^{-3}$ meters) by 2.7 mm. Using other combinations of material, thickness, width, and length, heating power of about 0.5 watts is also easily achieved. The exact size and power of the heater is adjusted in various embodiments for various microcoolers since the amount of power to raise the temperature of the orifice sufficiently to melt the frozen contaminates depends on the particular microcooler.

Figure 4:
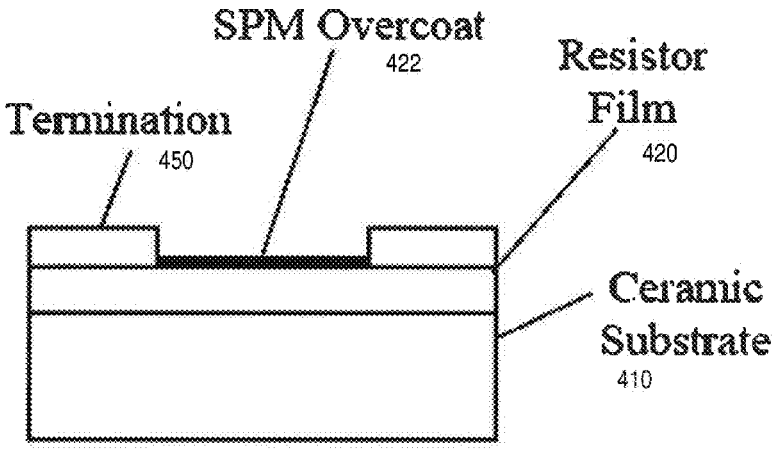
FIG. 4 is a diagram that illustrates an example cross section for a thin layer of electrical resistive heating material and electrodes, according to various embodiments.

FIG. 4 is a diagram that illustrates an example cross section for a thin layer of electrical resistive heating material and electrodes, according to various embodiments. For example, a heater with surface passivation methods (SPM) for anti-corrosion protection includes a ceramic substrate 410 coated with a thin film 420 (e.g., of Nichrome) and an SPM overcoat 422. The SPM overcoat protects the thin film resistor from degradation when heated and from interaction with a fluid in the microchannels and orifice. Termination pads 450 are provided as electrodes for connection to an electrical circuit, e.g., as electrodes 250*a* and 250*b* or 350*a* and 250*b* in a circuit that includes the electrodes controller 270. In some embodiments, in a direction perpendicular to the plane of the drawing, the space between pads 450 conforms to the first and second microchannels and the orifice between.

Figure 5:
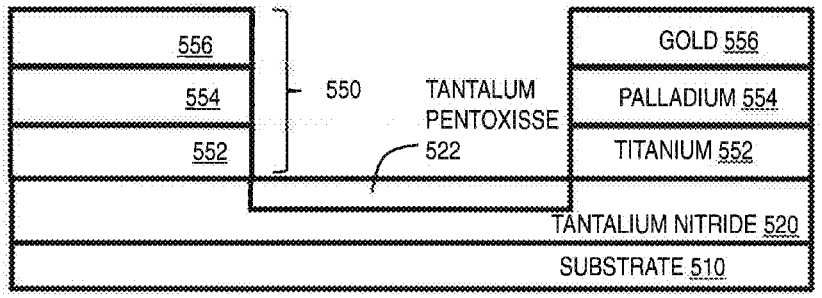
FIG. 5 is a diagram that illustrates an example cross section for a thin layer of electrical resistive heating material and electrodes, according to one embodiment.

FIG. 5 is a diagram that illustrates an example cross section for a thin layer of electrical resistive heating material and electrodes, according to one embodiment, in this embodiment, a tantalum nitride resistive material with tantalum oxide passivation for anti-corrosion protection is used. As illustrated, a substrate 510 is coated with a film of tantalum nitride 520 which, in turn, is coated with a film of tantalum pentoxide 522.

A pair of termination pads 550 are provided as electrodes for connection to an electrical circuit. Gold easily diffuses into other metals and can cause objectionable intermetallic to form. These have properties that degrade the performance of the ohmic contact to devices. Thus a diffusion barrier is typically used to prevent this diffusion. The common metals used in the intermediate position of the diffusion barrier typically are palladium and titanium. Thus, in the illustrated embodiment, the termination pads 550 each include three layers, gold 556 over palladium (Pd) 554 and titanium (Ti) 552, with the titanium layer 552 being positioned in contact with the tantalum nitride thin film coating 520.

It will be appreciated by those skilled in the art that both of the above structures are compatible with photolithographic thin film evaporation, and metallization techniques. Further, the thickness of the gold termination pads is preferably between about 50 to about 150 micro-inches (1 micro-inch=$10^{-6}$ inches) which is about 1.2 to about 3.8 μm. Still further, the thickness of the Ti and Pd layers is in the range of about 5 to about 50 micro-inches, which is about 0.1 to about 1.2 μm. In some embodiments, in a direction perpendicular to the plane of the drawing, the space between pads 550 conforms to the first and second microchannels and the orifice between.

Figure 6A:
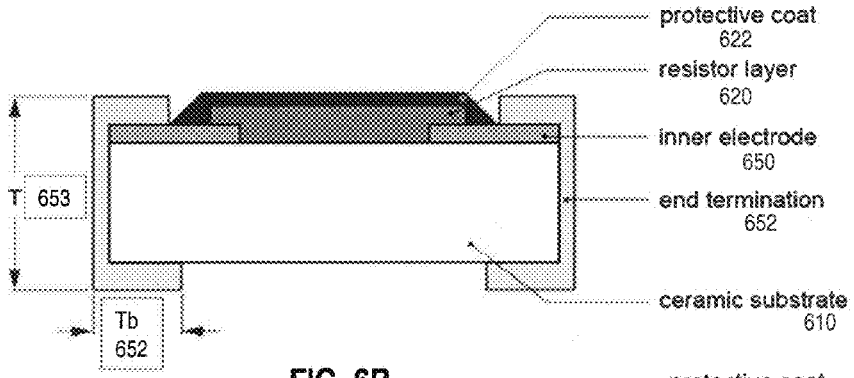
FIG. 6A is a diagram that illustrates an example cross section of an electronic de-clogging component for a microcooler, according to another embodiment.

FIG. 6A is a diagram that illustrates an example cross section of an electronic de-clogging component for a microcooler, according to another embodiment. In this embodiment, the thin film of resistive heating material is not deposited in a serpentine pattern. This structure is just a single square; thus the ohms per unit area of the deposited material is advantageously high which is achieved by making the layer thinner. However, a thin layer of resistor material can be damaged more easily by high amperage current. As shown, a ceramic substrate 610 is coated with a resistive heating material layer 620, which, in turn, is coated with a protective coating 622. At least one inner electrode 650 is provided and disposed on the ceramic substrate 610. End terminations 652 are provided and connected to the substrate 610 at its distal ends for connection to an electrical circuit. The end termination extends around the bottom of the substrate 610 a distance Tb 652 and has a thickness T 653. In the illustrated embodiment, the structure is generally square shaped.

Figure 6B:
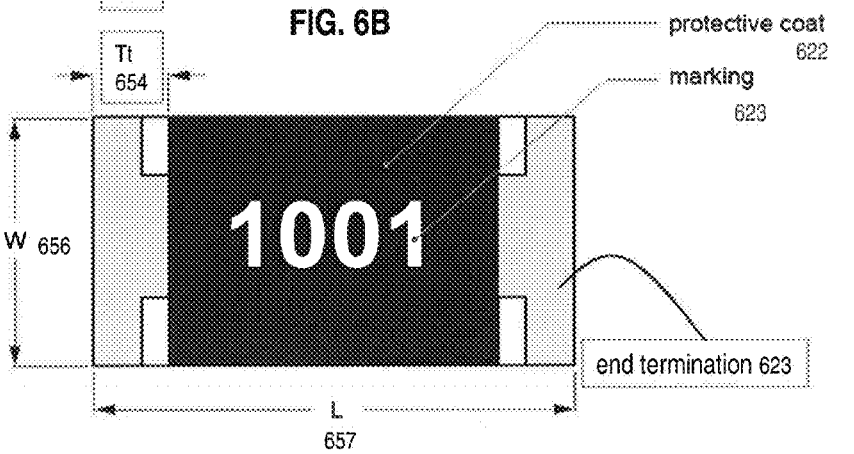
FIG. 6B is a diagram that illustrates an example plan view of an electronic de-clogging component for a microcooler, according to the embodiment of FIG. 6A.

FIG. 6B is a diagram that illustrates an example plan view of an electronic de-clogging component for a microcooler, according to the embodiment of FIG. 6A. In this view the protective coat 622 and end termination 652 are visible. The end termination extends around the top of the inner electrode 650 a distance Tt 654 and has a width W 656. The heater and end termination has a length L 657. The length 657 and width 656 are configured to reside within the vicinity of an orifice of a microcooler. The numerals ("1001") apparent on the protective coat 622 are markings that do not affect the structure or operation of the device.

Method of Fabricating

Figure 7:
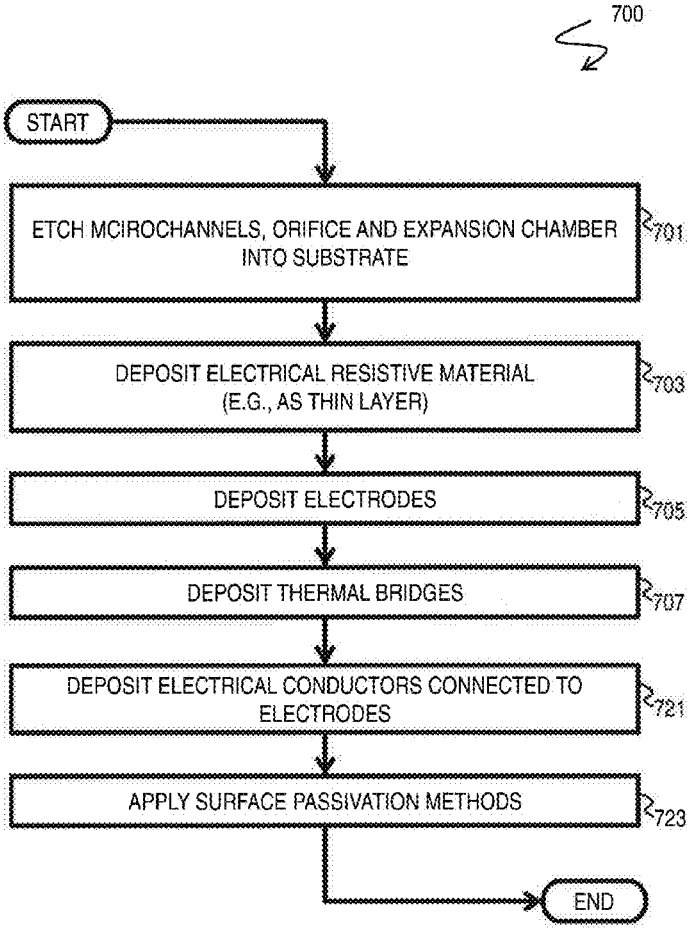
FIG. 7 is a flow diagram that illustrates an example method for fabricating a microcooler with an electronic de-clogging component, according to an embodiment.

FIG. 7 is a flow chart that illustrates an example method for fabricating a microcooler with an electronic de-clogging component, according to an embodiment. Although steps are shown in FIG. 7, and subsequent flow chart FIG. 8, as integral blocks in a particular order for purposes of illustration, in other embodiments, one or more steps, or portions thereof, are performed in a different order or overlapping in time, in series or in parallel, or are omitted, or additional steps are added, or the method is changed in some combination of ways.

In step 701, one or more features, including one or more microchannels, orifices and expansion chambers, are etched into a substrate, such as a thermally insulating substrate for JT microcoolers. Any method for forming the features is performed in various embodiments, including injection molding, laser etching, or use of a positive or negative photoresist exposed using photolithography techniques with either or both chemical etching and plasma etching.

In step 703, the electrical resistive heating material is deposited on the substrate. For example, photolithographic techniques are used to define the serpentine path on the top and/or on the bottom over the orifice area. The microcooler itself is fabricated using photolithographic techniques and this step 703 is just an extension of that processing. It is not necessarily a separate device that is placed" onto the microcooler. Since the microcooler is fabricated with several layers and steps on a sheets of glass, the photolithographic technique is the preferred approach to form the de-clogger heater. A mask to form the pattern for deposition may be used in some embodiments, e.g., as formed using a positive or negative photoresist and photolithographic techniques. Any method may be used to deposit the heating material in the gaps in the mask or without a mask, including 3D printing, precipitation from solution, sputtering, and thin film evaporation techniques. In step 705, the material for the electrodes is deposited in the spaces therefor using any method, such as 3D printing and sputtering using a photolithographic mask formed with a positive or negative photoresist. In some embodiments, step 705 includes depositing multiple layers of metal to form the electrode, e.g., as depicted in FIG. 5, using the same or different masks, if any.

In step 707 other materials are deposited, e.g., thermally conductive materials for the thermal bridges in some embodiments. In some embodiments step 707 is omitted.

In step 721, other portions of the circuit are deposited on the substrate, such as conductors to connect the electrodes, such as electrodes 250*a* and 250*b*, to the electrodes controller 270. In some embodiments, the rest of the circuit is a separate device external to the substrate to be soldered to the electrodes in a later step, and step 721 is omitted.

In step 723 surface passivation methods (SPM) are applied to the exposed surfaces of the resistive heating material to protect the material from decomposition due to exposure to a fluid in the vicinity of the orifice or due to heating. The surface passivation may be performed with a mask to confine the passivation to a certain area.

Method of Operating

Figure 8:
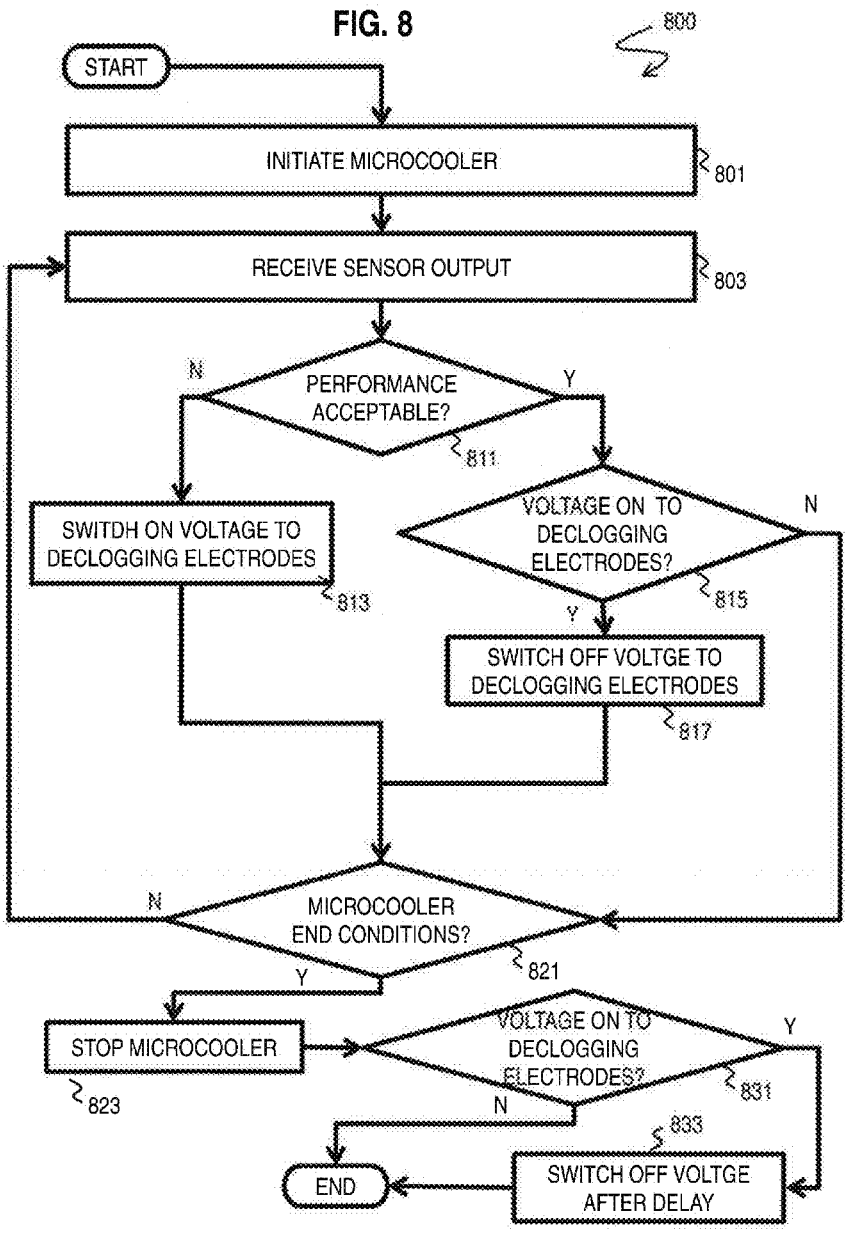
FIG. 8 is a flow diagram that illustrates an example method for operating a microcooler with an electronic de-clogging component, according to an embodiment.

FIG. 8 is a flow chart that illustrates an example method for operating a microcooler with an electronic de-clogging component, according to an embodiment. In this embodiment, a system with at least one sensor and an electrodes controller is used. In some embodiments, one or more of steps 801 through step 823 are performed at a chip set described below, as the electrodes controller 270.

In step 801, the microcooler is initiated to begin cooling the thermal load. In some embodiments, step 801 is coordinated with a command to begin using the device that constitutes the thermal load, such as an infrared focal plane array.

In step 803, output is received from one or more sensors, such as the flow or pressures sensors 221, 222 or temperature sensor 223 or thermal load 290 itself. In some embodiments, step 803 includes sending a message or signal to the sensor to request or initiate sensor output.

In step 811, it is determined whether performance of the microcooler is acceptable based on the sensor output, or, instead, that one or more of the effects of clogging are detected in the sensor output. For example, if flow rate is acceptable and not too low in the microchannels on either side of the orifice, then performance of the microcooler is acceptable. Similarly, if the temperature at the temperature load is not too high, e.g., not above some predetermined temperature threshold indicative of microcooler failure, then performance of the microcooler is acceptable. Similarly, if the thermal load includes a sensor and the statistics of data from that sensor of the thermal load do not indicate a temperature that is too high, then performance of the microcooler is acceptable. If performance of the microcooler is determined to be not acceptable, however, then control passes to step 813.

In step 813 the voltage to the de-clogging electrodes (e.g., 250*a* and 250*b*) is switched on. This causes the electrical resistive heating material to heat up according to Equation 2 to remove any particles or condensates in the vicinity of the orifice, which would lead to clogging. In some embodiments, the voltage is switched on for a limited time, e.g., a few milliseconds and automatically switches off after that time during step 813. Control then passes to step 821.

In step 821, it is determined whether conditions are satisfied for ending microcooler operations. For example, microcooler operations end under one or more of the following conditions: the end of operation of the thermal load; the cooling of the thermal load below some low temperature threshold; receipt of a command to end operations of the thermal load; or receipt of a command to end microcooler operations. If conditions are not satisfied for ending microcooler operations, then control passes back to step 803 to continue getting sensor output.

If it is determined in step 811 that performance of the microcooler is acceptable based on the sensor output (and thus, that one or more of the effects of clogging are not detected in the sensor output), then control passes to step 815.

In step 815, it is determined whether the voltage to the de-clogging electrodes is switched on. If so, control passes to step 817 to switch off the voltage to the de-clogging electrodes. Then control passes to step 821, described above. If the voltage to the de-clogging electrodes is not switched on, then control passes directly to step 821, described above.

If it is determined, in step 821, that conditions are satisfied for ending microcooler operations, then control passes to step 823 to stop the microcooler operation. Control then passes to step 831.

In step 831 it is again determined whether the voltage to the de-clogging electrodes is switched on. If not, then the process ends. If so, control passes to step 833 to switch off the voltage to the de-clogging electrodes after a delay sufficient to expect that any particulates or condensates have been melted, burned or otherwise disassociated. After the voltage is switched off to the de-clogging electrodes, then the process ends.

The above embodiments are designed to overcome the noted shortcomings associated with conventional systems, apparatus, and methods associated with at least Joule-Thomson (J-T) microcoolers. In example embodiments, fabricating a system of heating elements and/or electrodes near the orifice or in the body of the high and/or low pressure microchannels to the expansion chamber of a J-T microcooler allow for an electronic method of eliminating clogs. Example embodiments provide systems that can be run in a feedback loop responsive to temperature, pressure, or flow rate sensors positioned anywhere in the microcooler, making it an extremely effective and power efficient means to manage clogging failures automatically. In example embodiments heating elements and/or electrodes can be integrated alongside thermal bridges in "in-plane" type J-T microcoolers by positioning them in mask design. Advantageously, the foregoing configuration permits a solution which does not require an interruption of process flow or an increase in complexity.

Computational Hardware

Figure 9:
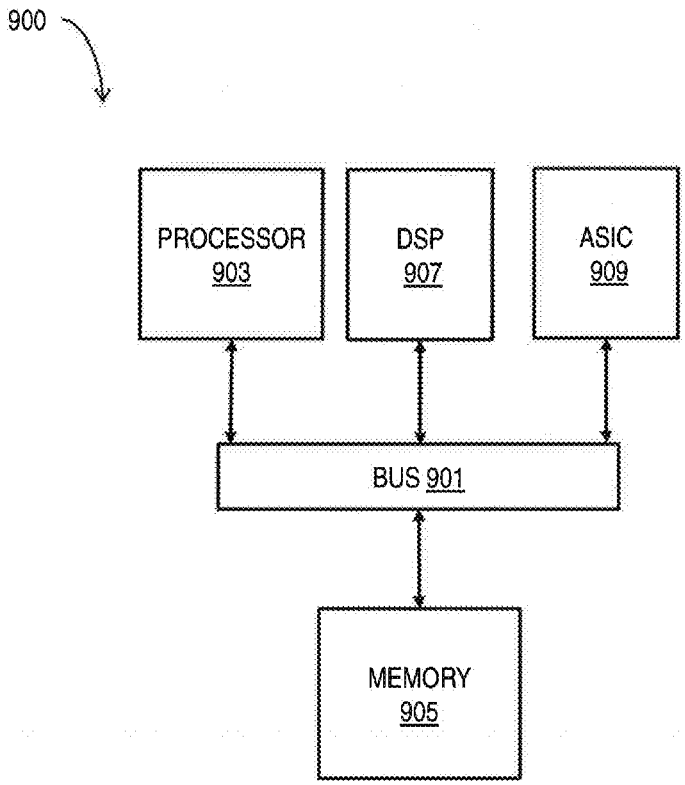
FIG. 9 illustrates a chip set upon which an embodiment may be implemented.

FIG. 9 illustrates a chip set 900 upon which an embodiment of the invention may be implemented. Chip set 900 is programmed to perform one or more steps of a method described herein and includes, for instance, the processor and memory components. By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set can be implemented in a single chip. Chip set 900, or a portion thereof, constitutes a means for performing one or more steps of a method described herein.

Information is represented as physical signals of a measurable phenomenon, typically electric voltages, but including, in other embodiments, such phenomena as magnetic, electromagnetic, pressure, chemical, molecular atomic and quantum interactions. For example, north and south magnetic fields, or a zero and non-zero electric voltage, represent two states (0, 1) of a binary digit (bit).). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range. Chip set 900, or a portion thereof, constitutes a means for performing one or more steps of one or more methods described herein.

A sequence of binary digits constitutes digital data that is used to represent a number or code for a character. One or more processors 903 for processing information perform a set of operations on information. The set of operations include bringing information in from the bus and placing information on the bus. The set of operations also typically include comparing two or more units of information, shifting positions of units of information, and combining two or more units of information, such as by addition or multiplication. A sequence of operations to be executed by the processor 903 constitute computer instructions.

The chip set also includes a memory 905. The memory 905, such as a random access memory (RAM) or other dynamic storage device, stores information including computer instructions. Dynamic memory allows information stored therein to be changed by the chip set 900. RAM allows a unit of information stored at a location called a memory address to be stored and retrieved independently of information at neighboring addresses. The memory 905 is also used by the processor 903 to store temporary values during execution of computer instructions. The chip set 900 also includes a read only memory (ROM) or other static storage device coupled to the bus for storing static information, including instructions, that is not changed by the chip set 900. Also included is a non-volatile (persistent) storage device, such as a magnetic disk or optical disk, for storing information, including instructions, that persists even when the chip set 900 is turned off or otherwise loses power In one embodiment, the chip set 900 includes a communication mechanism such as a bus 901 for passing information among the components of the chip set 900. A processor 903 has connectivity to the bus 901 to execute instructions and process information stored in, for example, a memory 905. The processor 903 may include one or more processing cores with each core configured to perform independently. A multi-core processor enables multiprocessing within a single physical package. Examples of a multi-core processor include two, four, eight, or greater numbers of processing cores. Alternatively or in addition, the processor 903 may include one or more microprocessors configured in tandem via the bus 901 to enable independent execution of instructions, pipelining, and multithreading. The processor 903 may also be accompanied with one or more specialized components to perform certain processing functions and tasks such as one or more digital signal processors (DSP) 907, or one or more application-specific integrated circuits (ASIC) 909. A DSP 907 typically is configured to process real-world signals (e.g., sound) in real time independently of the processor 903. Similarly, an ASIC 909 can be configured to performed specialized functions not easily performed by a general purposed processor. Other specialized components to aid in performing the inventive functions described herein include one or more field programmable gate arrays (FPGA) (not shown), one or more controllers (not shown), or one or more other special-purpose computer chips.

The processor 903 and accompanying components have connectivity to the memory 905 via the bus 901. The memory 905 includes both dynamic memory (e.g., RAM, magnetic disk, writable optical disk, etc.) and static memory (e.g., ROM, CD-ROM, etc.) for storing executable instructions that when executed perform one or more steps of a method described herein. The memory 905 also stores the data associated with or generated by the execution of one or more steps of the methods described herein.

Alterations, Modifications and Extensions

While embodiments have been described with reference to various examples, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered. Moreover, unless specifically stated, any use of the terms first, second, etc., does not denote any order or importance, but rather the terms first, second, etc., are used to distinguish one element from another.

We claim:

1. An apparatus comprising:

a substrate having disposed therein:

a first microchannel;

a second microchannel;

an orifice disposed between the first microchannel and the second microchannel and in fluid communication with both;

a pair of electrodes disposed in a vicinity of the orifice; and an electrical resistive heating material disposed in electrical communication with the pair of electrodes and configured to be in thermal contact with a fluid in the vicinity of the orifice.

2. An apparatus as recited in claim 1, wherein the resistive heating material is configured in a serpentine pattern on the substrate.

3. An apparatus as recited in claim 1, wherein the resistive heating material is an evaporated thin film layer deposited on the substrate.

4. An apparatus as recited in claim 1, wherein the resistive heating material is selected from a group comprising chromium, nickel, Nichrome, titanium/chromium layers, tantalum nitride, and Kanthal.

5. An apparatus as recited in claim 1, further comprising a passivation layer disposed on the resistive heating material, the passivation layer configured to separate the resistive heating material from fluid in the first microchannel and the second microchannel and the orifice.

6. An apparatus as recited in claim 1, wherein:

the second microchannel is an expansion chamber; and the orifice is configured to induce a fluid under pressure in the microchannel to expand into low pressure in the expansion chamber.

7. A system comprising;

an apparatus as recited in claim 1; and a voltage source configured to apply a voltage across the pair of electrodes, wherein the voltage is sufficient to induce sufficient heating in the electrical resistive heating material to melt a particle or condensate clogging the orifice without significant damage to the electrical resistive heating material.

8. A system as recited in claim 6, wherein the resistive heating material is configured as a thin film in a serpentine pattern on the substrate.

9. A system as recited in claim 7, wherein a current flowing through the resistive heating material as a result of the voltage is less than about $10^{-2}$ amperes.

10. A system as recited in claim 6, wherein the sufficient heating raises temperature in the particle or condensate to a value in a range from about 150 Kelvin to about 300 Kelvin.

11. A system as recited in claim 6, further comprising:

at least one sensor configured to detect an effect of clogging at the orifice; and a processor configured to perform at least the steps of:

receiving sensor output from the at least one sensor, determining an effect of clogging based on the sensor output, and if it is determined that there is an effect of clogging, then causing the voltage source to apply the voltage across the pair of electrodes.

12. A system as recited in claim 11, wherein the sensor is one or more sensors from a group consisting of a flow meter configured to determine flow rate of fluid in the first microchannel or the second microchannel, and a temperature sensor configured to measure a temperature of a thermal load in thermal contact with the second microchannel.

13. A system as recited in claim 11, wherein:

the sensor comprises a thermal load in thermal contact with the second microchannel; and determining the effect of clogging comprises determining a change in a statistic of data from the sensor.

14. A method comprising:

operating the apparatus of claim 1 to cool a thermal load in thermal contact with the second microchannel;

obtaining sensor output from at least one sensor configured to detect an effect of clogging at the orifice;

determining an effect of clogging based on the sensor output; and if it is determined that there is an effect of clogging, then causing a voltage source to apply a voltage across the pair of electrodes for a limited time, wherein the voltage for the limited time is sufficient to induce sufficient heating in the electrical resistive material to melt a particle or condensate clogging the orifice without significant damage to the electrical resistive material.

* * * * *